US009303391B2

(12) United States Patent
Leichty et al.

(10) Patent No.: US 9,303,391 B2
(45) Date of Patent: Apr. 5, 2016

(54) FAUCET MOUNT ASSEMBLY

(75) Inventors: Ryan Leichty, Sheboygan, WI (US); Michael Furseth, Cumberland, WI (US)

(73) Assignee: KOHLER CO., Kohler, WI (US)

( * ) Notice: Subject to any disclaimer, the term of this patent is extended or adjusted under 35 U.S.C. 154(b) by 1164 days.

(21) Appl. No.: 13/020,671

(22) Filed: Feb. 3, 2011

(65) Prior Publication Data

US 2012/0067978 A1 Mar. 22, 2012

Related U.S. Application Data

(60) Provisional application No. 61/383,642, filed on Sep. 16, 2010.

(51) Int. Cl.
*E03C 1/04* (2006.01)

(52) U.S. Cl.
CPC ..... *E03C 1/0401* (2013.01); *E03C 1/0403* (2013.01)

(58) Field of Classification Search
CPC .. E03C 1/04; E03C 1/0404; E03C 2001/0416
USPC ..... 4/675–678; 137/801
See application file for complete search history.

(56) References Cited

U.S. PATENT DOCUMENTS 4,306,468 A 12/1981 Bolgert
4,349,940 A 9/1982 Fleischmann et al.
4,463,460 A * 8/1984 Arnold et al. ..... 4/678
4,478,249 A 10/1984 Fleischmann
4,515,037 A 5/1985 Block
4,552,171 A * 11/1985 Farrell et al. ..... 4/677
4,554,690 A 11/1985 Knapp et al.
4,796,310 A 1/1989 Freville et al.
4,821,765 A 4/1989 Iqbal et al.
4,829,632 A 5/1989 Freier et al.
4,915,347 A 4/1990 Iqbal et al.
4,961,443 A 10/1990 Buccicone et al.
4,973,025 A 11/1990 Iqbal
4,974,268 A 12/1990 Cors et al.
4,998,321 A 3/1991 Gaffney et al.
5,010,917 A 4/1991 Iqbal
5,016,297 A 5/1991 Sauter et al.
5,095,934 A 3/1992 Iqbal
5,103,856 A 4/1992 Fleischmann
5,103,857 A 4/1992 Kuhn et al.
5,333,327 A 8/1994 Redding et al.
5,361,431 A 11/1994 Freier et al.
5,398,717 A 3/1995 Goncze
5,417,242 A 5/1995 Goncze
5,531,524 A 7/1996 Brouwer
5,575,424 A 11/1996 Fleischmann
5,611,628 A 3/1997 Brouwer
5,752,541 A 5/1998 Gonzalez
5,826,788 A 10/1998 Redding
5,911,240 A 6/1999 Kolar et al.
5,915,665 A 6/1999 Paese et al.

(Continued)

*Primary Examiner* — Tuan N Nguyen
(74) *Attorney, Agent, or Firm* — Foley & Lardner LLP

(57) ABSTRACT

A faucet includes a faucet mount assembly for mounting the faucet to a surface and for communicating and mixing hot and cold water to a user. The faucet mount assembly generally includes a mounting plate, a fluid tube, and one or more valve housings. The valve housings are coupled to the mounting plate and are configured to receive valve components for selectively allowing water to flow through the valve housings. The fluid tube is disposed in fluid communication with outlets of the valve housings and is configured to transfer water from the valve housings to a spout for delivery to a user.

26 Claims, 13 Drawing Sheets

(56) References Cited

U.S. PATENT DOCUMENTS

| | | | | |
|---|---|---|---|---|
| 6,067,673 | A | 5/2000 | Paese et al. | |
| 6,182,305 | B1 | 2/2001 | O'Connell et al. | |
| 6,206,340 | B1 | 3/2001 | Paese et al. | |
| 6,220,278 | B1 | 4/2001 | Sauter et al. | |
| 6,234,192 | B1 | 5/2001 | Esche et al. | |
| 6,248,982 | B1 | 6/2001 | Reid et al. | |
| 6,250,601 | B1 | 6/2001 | Kolar et al. | |
| 6,286,808 | B1 | 9/2001 | Slothower et al. | |
| 6,296,011 | B1 | 10/2001 | Esche et al. | |
| 6,360,380 | B1 | 3/2002 | Swart et al. | |
| 6,388,609 | B2 | 5/2002 | Paese et al. | |
| 6,421,849 | B1 | 7/2002 | Gray | |
| 6,484,330 | B2 | 11/2002 | Gray et al. | |
| 6,484,953 | B2 | 11/2002 | Freier | |
| 6,568,655 | B2 | 5/2003 | Paese et al. | |
| 6,591,434 | B1 | 7/2003 | De Cleene et al. | |
| 6,631,525 | B2 | 10/2003 | Piatt et al. | |
| 6,637,051 | B1 | 10/2003 | Swart | |
| 6,666,227 | B2 | 12/2003 | Erickson | |
| 6,694,544 | B2 | 2/2004 | Piatt | |
| 6,725,472 | B2 | 4/2004 | Gray et al. | |
| 6,757,921 | B2 | 7/2004 | Esche | |
| 6,971,591 | B2 | 12/2005 | Fleischmann | |
| 7,000,266 | B2 | 2/2006 | Piatt et al. | |
| 7,174,581 | B2 * | 2/2007 | McNerney et al. | 4/675 |
| 7,331,359 | B2 | 2/2008 | Shay | |
| 7,404,413 | B2 * | 7/2008 | Chang | 137/801 |
| 7,509,971 | B2 | 3/2009 | Kajuch | |
| 7,575,025 | B2 | 8/2009 | Fleischmann | |
| 7,627,909 | B2 | 12/2009 | Esche | |
| 7,658,202 | B2 | 2/2010 | Mueller et al. | |
| 7,658,206 | B2 | 2/2010 | Fleischmann | |
| 7,731,310 | B2 | 6/2010 | Kohlmann et al. | |
| 7,748,798 | B2 | 7/2010 | Letourneau et al. | |
| 7,779,865 | B2 | 8/2010 | Shay et al. | |
| 7,814,927 | B2 | 10/2010 | Hansen | |
| 7,909,269 | B2 | 3/2011 | Erickson et al. | |
| 7,934,520 | B2 | 5/2011 | Esche et al. | |
| 7,959,241 | B2 | 6/2011 | Kohlmann et al. | |
| 7,992,235 | B2 | 8/2011 | Booth | |
| 8,056,574 | B2 | 11/2011 | Erickson et al. | |
| 8,061,386 | B2 | 11/2011 | Mueller et al. | |
| 8,070,076 | B2 | 12/2011 | Erickson et al. | |
| 8,079,381 | B2 | 12/2011 | Fischer et al. | |
| 8,186,375 | B2 | 5/2012 | Andersen et al. | |
| 8,212,994 | B2 | 7/2012 | Liu | |
| 8,215,334 | B2 | 7/2012 | Esche et al. | |
| 2001/0009404 | A1 | 7/2001 | Paese et al. | |
| 2002/0171056 | A1 | 11/2002 | Paese et al. | |
| 2006/0174946 | A1 | 8/2006 | Kajuch | |
| 2006/0231141 | A1 | 10/2006 | Shay | |
| 2007/0186343 | A1 | 8/2007 | Mueller | |
| 2009/0200794 | A1 | 8/2009 | Esche et al. | |
| 2009/0242058 | A1 | 10/2009 | Hansen | |
| 2011/0079307 | A1 * | 4/2011 | Marty et al. | 137/801 |
| 2012/0067978 | A1 | 3/2012 | Leichty et al. | |
| 2012/0151670 | A1 | 6/2012 | Aykens et al. | |
| 2012/0151671 | A1 | 6/2012 | Aykens et al. | |
| 2012/0174306 | A1 | 7/2012 | Chen et al. | |

* cited by examiner

FAUCET MOUNT ASSEMBLY

CROSS-REFERENCE TO RELATED PATENT APPLICATIONS

The present application claims priority to and the benefit of U.S. Provisional Patent Application No. 61/383,642, filed Sep. 16, 2010, the disclosure of which is incorporated herein by reference in its entirety.

BACKGROUND

The present application relates generally to faucet assemblies. In particular, the present application relates to a faucet mount assembly.

Conventional faucets generally include external components (e.g., spout, handles or levers, bonnets, and an escutcheon or base, etc.) and internal components (e.g., yoke, valves, etc.). The bonnets and escutcheon are generally configured to cover the yoke and valves to conceal them from the view of the user. Yokes receive water (i.e., selectively through opening and closing of the valves), mix hot and cold water, and transfer water to the spout. Yokes also provide a structure for faucet rigidity and for mounting the faucet to a surface such as a countertop or other surface where the faucet may be mounted.

Referring to FIG. 1, yokes have conventionally been provided as unitary members that are cast (e.g., sand cast) from a material such as brass. The materials and manufacturing processes used to form conventional yokes limit variations to the form of the yoke and, thus, dictate certain aesthetics of faucets. Further, because certain grades of brass may contain trace amounts of elements such as lead, faucet manufacturers have been forced to utilize different types of brass that include fewer undesirable impurity elements. These grades of brass, however, are significantly more expensive than the grades of brass that have historically been used, which has resulted in increased costs to manufacture faucets employing brass yokes. Yokes made from the lower-impurity brass are also more difficult to manufacture, which further increases the manufacturing cost.

It would be advantageous to produce a faucet that includes a yoke that is configured to address one or more of the foregoing issues. It would also be desirable to provide a yoke that provides the functions of traditional yokes but that utilizes materials that are relatively simple to form, lightweight, and low cost as compared to brass materials used previously.

SUMMARY

According to an exemplary embodiment, a faucet mount assembly generally includes a mounting plate, first and second valve housings, and a fluid tube. At least one of the first and second valve housings is coupled to the mounting plate. The fluid tube is removably coupled to and in fluid communication with the first valve housing and the second valve housing. The fluid tube also includes an outlet for routing water from the first and second valve housings to a spout of a faucet.

According to an exemplary embodiment, a faucet assembly generally includes a spout and a faucet mount assembly. The faucet mount generally includes a mounting plate, first and second valve housings, and a fluid tube. The fluid tube is removably coupled to the first and second valve housings and is formed from a different material than the first and second valve housings. At least one of the first and second valve housings is rigidly coupled to the mounting plate. The fluid tube is in fluid communication with the first and second valve housings and the spout and is configured to be disposed above a mounting surface.

DETAILED DESCRIPTION

According to an exemplary embodiment, a faucet includes a multi-piece faucet mount assembly (i.e., a multi-piece yoke) to provide the same functional characteristics of conventional yokes (i.e., faucet rigidity, mounting, and mixing and delivery of water), while reducing the use of lead-containing components, reducing cost, and providing fewer limitations on the aesthetic designs of faucets.

According to an exemplary embodiment, the faucet includes a faucet mount assembly that includes a mounting plate, valve housings, and a fluid tube which provide structural rigidity to the faucet and control the mix and flow of hot and cold water to the user (i.e., through valve components disposed in the valve housings). External components of the faucet are coupled to the faucet mount assembly to provide the aesthetic feel for the faucet (i.e., generally hiding the faucet mount assembly from view of a user) and to enable the user to control the flow of hot and cold water.

Figure 1:
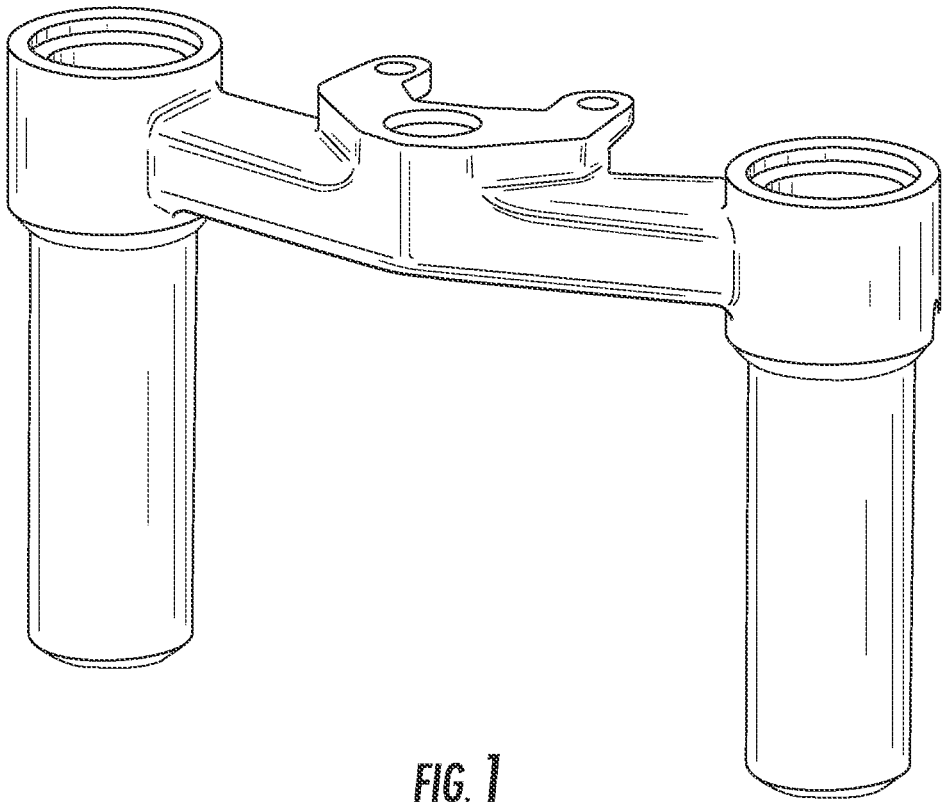
FIG. 1 (Prior Art)
FIG. 1 is a perspective view of a perspective view of a conventional yoke.
Figure 2:
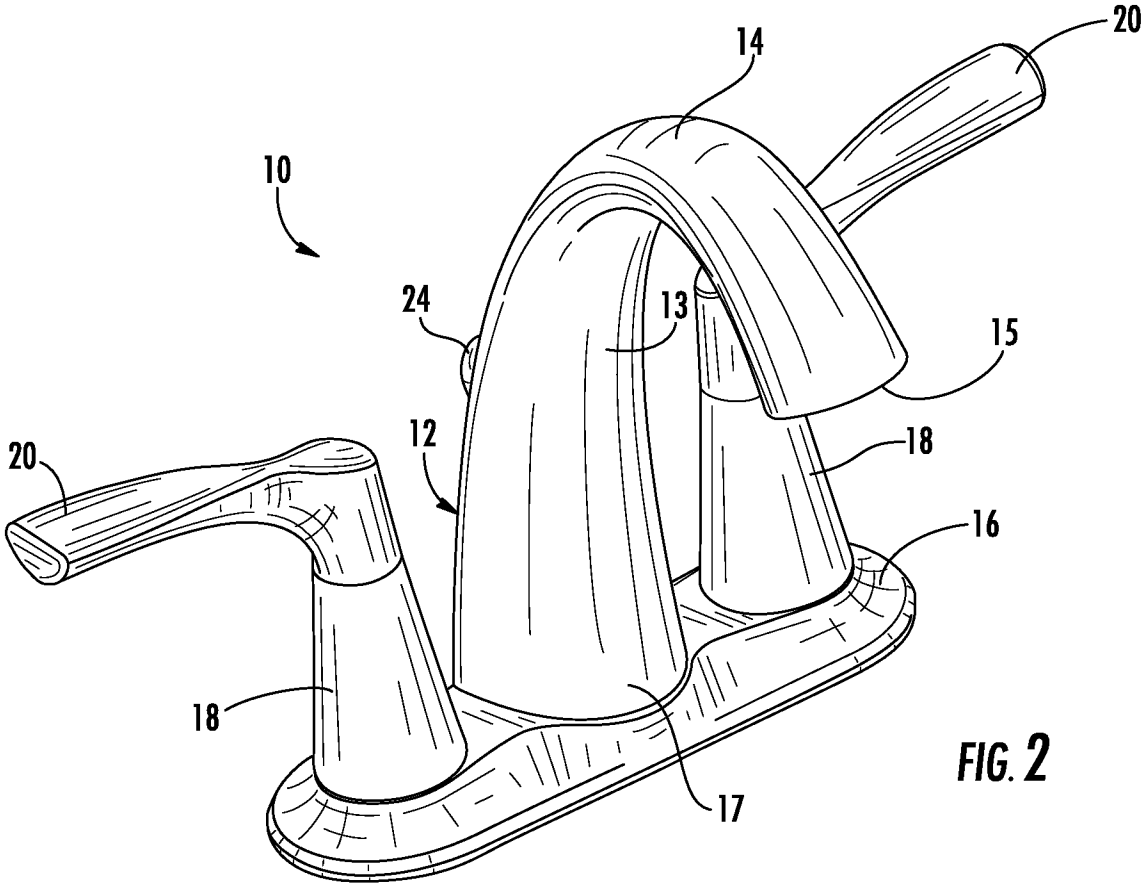
FIG. 2 is a perspective view of a faucet according to an exemplary embodiment.

Referring to FIG. 2, according to an exemplary embodiment, the external components of a faucet assembly 10 are depicted. The external components of the faucet assembly 10 generally include a spout body 12 and an escutcheon or base 16, with the spout body 12 including a bottom shroud 13 that forms a mounting end 17 and a top shroud 14 that forms a fluid outlet end 15. According to the exemplary embodiment shown in FIG. 2, the bottom shroud 13 and the top shroud 14 are part of a unitary piece, but according to other exemplary embodiments, the bottom shroud and the top shroud may be two separate components that are coupled together.

Two handle bonnets 18 are supported on the escutcheon 16 and are separately secured to the internal plumbing components as described herein. The example faucet assembly 10 also includes a pair of rotatable handles 20 to operate valves that control the flow of fluid, for example, hot and cold water, as described below. The handle bonnets 18 along with spout body 12 and the escutcheon 16 define a substantially closed chamber generally enclosing the internal plumbing components to be described more fully below.

Figure 3:
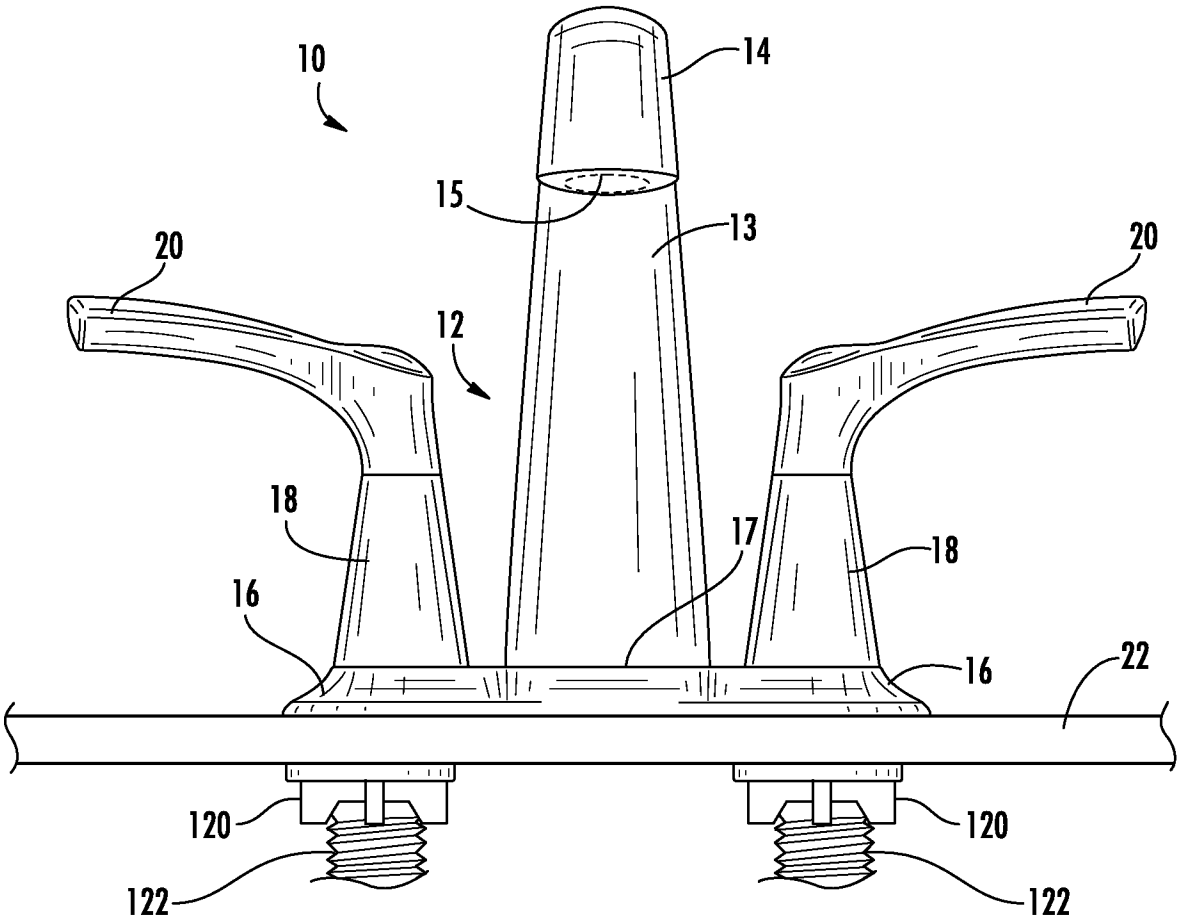
FIG. 3 is a front view of the faucet shown in FIG. 2 according to an exemplary embodiment.
Figure 4:
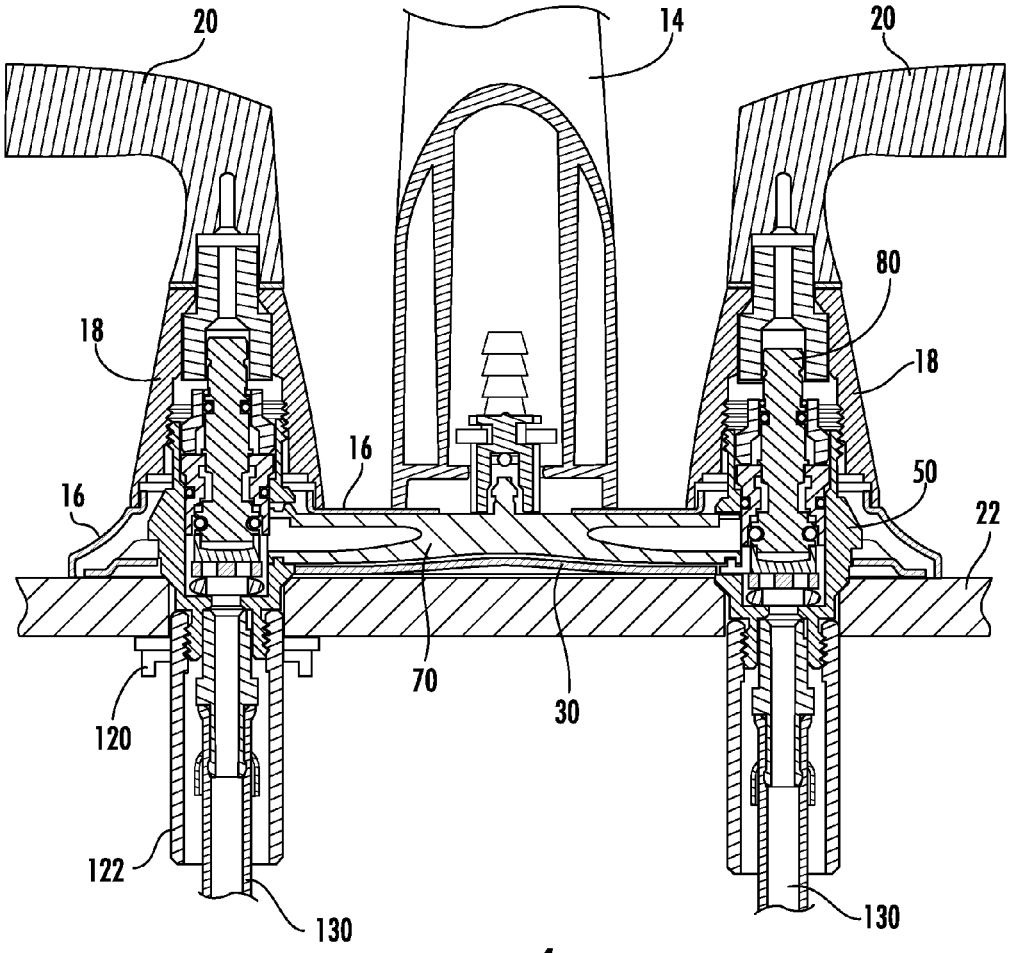
FIG. 4 is a partial cutaway view of the faucet according to an exemplary embodiment.
Figure 5:
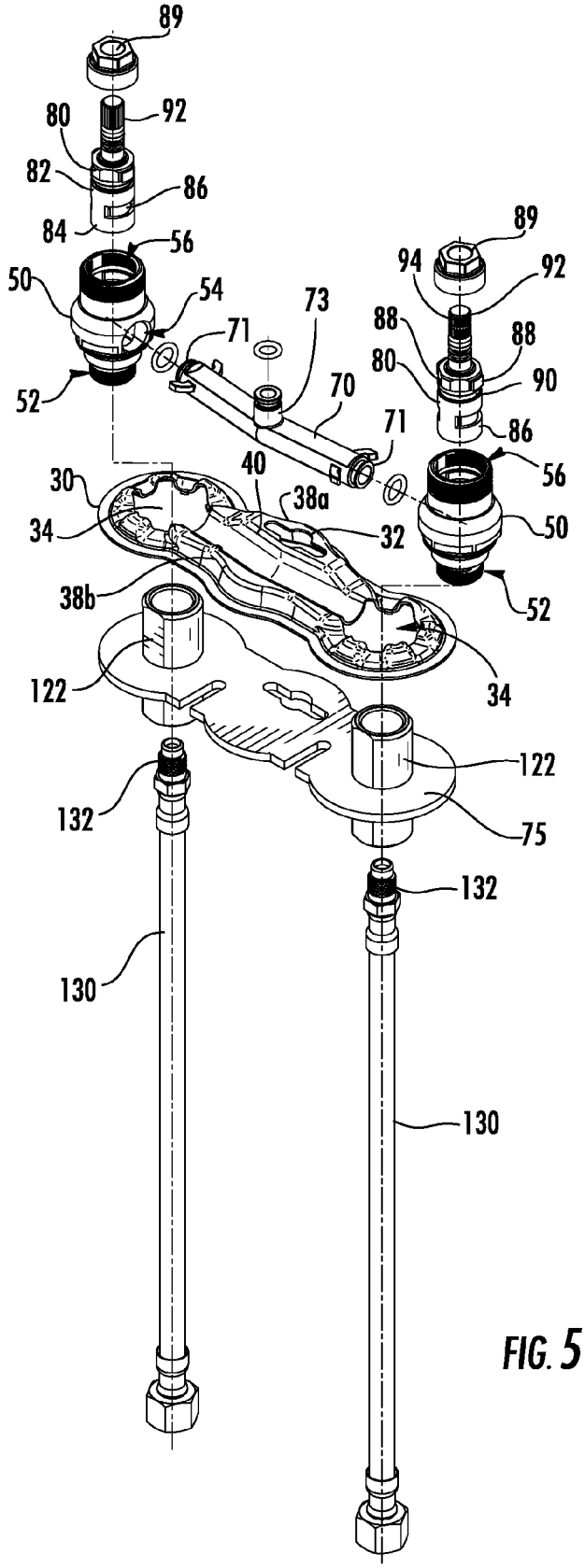
FIG. 5 is an exploded view of internal components of a faucet assembly according to an exemplary embodiment.
Figure 6:
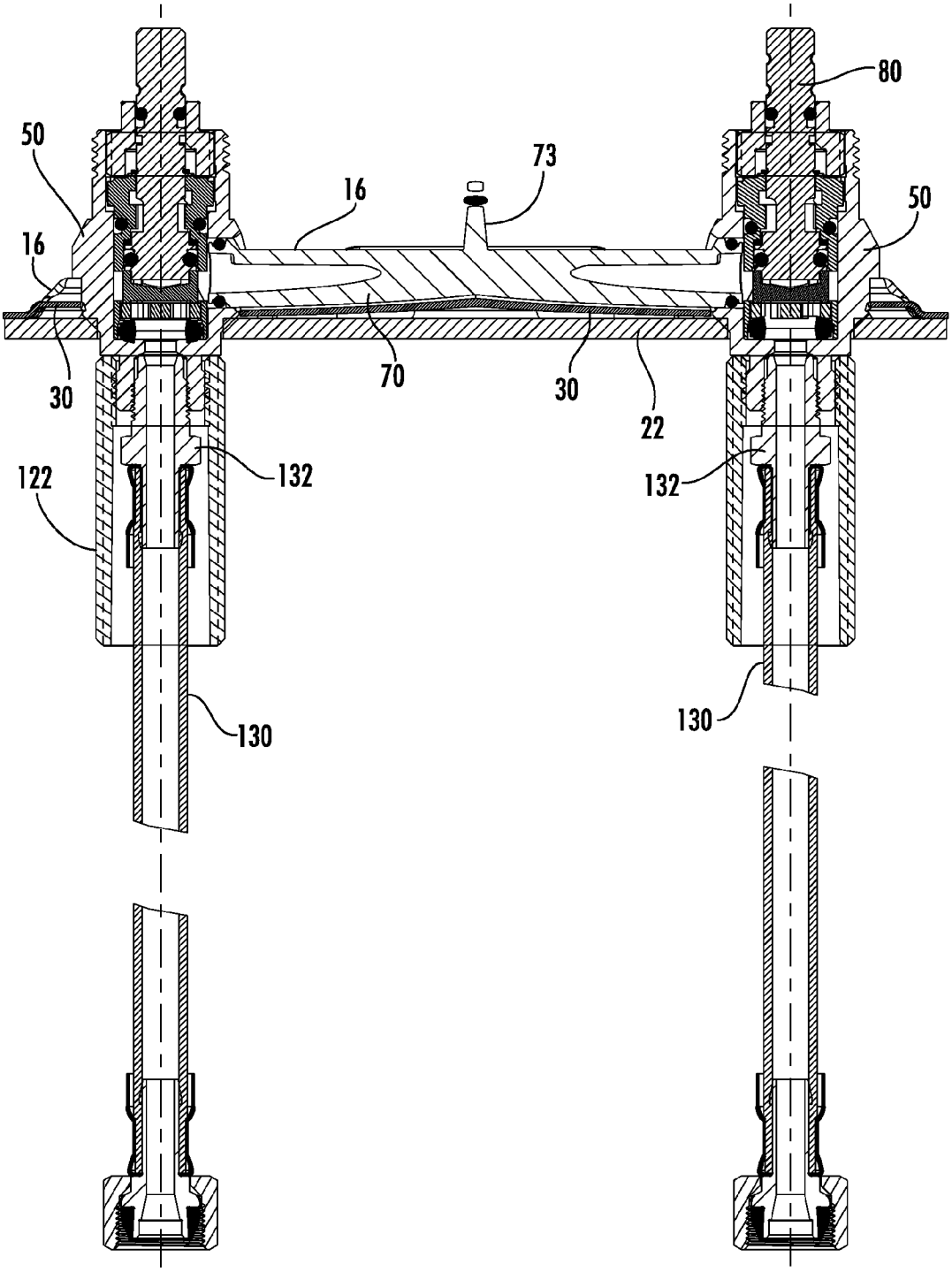
FIG. 6 is a cross-sectional view of the assembled internal components of the faucet assembly shown in FIG. 5.
Figure 7:
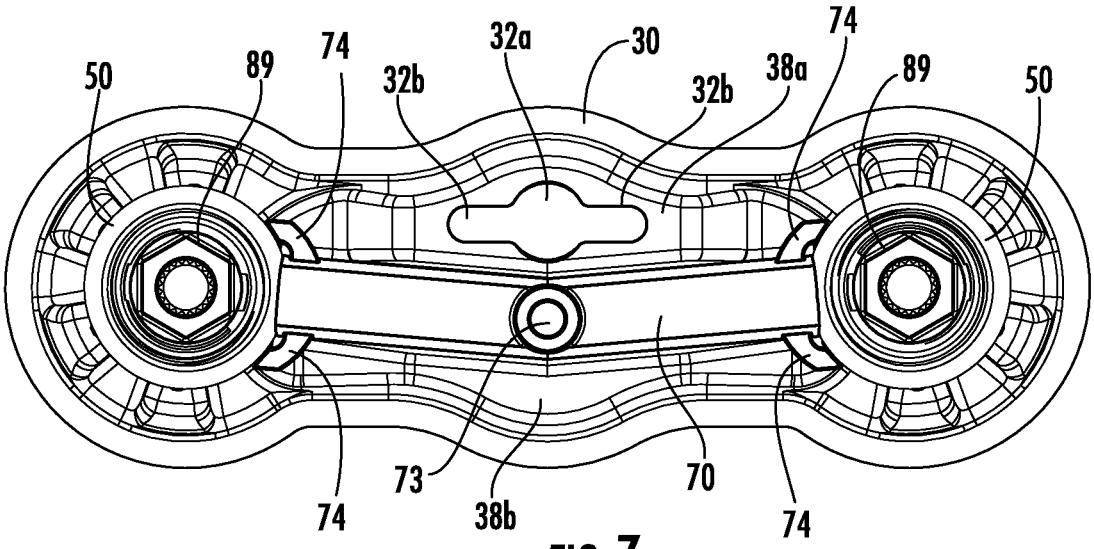
FIG. 7 is a top view of internal components of the faucet assembly shown in FIG. 6.

As illustrated in FIGS. 3-4, according to an exemplary embodiment, the faucet 10 is mounted to a faucet deck, or a support surface 22, such as, for example, a countertop. The spout body 12 includes an opening (not shown) generally located behind the spout body 12 through which a lift rod 24 (see FIG. 2) extends. The lift rod 24 includes a pull knob at an upper end, and extends through the escutcheon 16 and the support surface 22 to couple to a drain assembly (not shown) at a lower end. As will be appreciated, any of the external components, such as, for example, the spout body 12, the escutcheon 16, the handle bonnets 18, the handles 20, and/or the lift rod 24 may be substituted and/or interchanged with any suitable component for functional and/or aesthetic purposes as desired and may be made from any suitable material according to any suitable manufacturing method. Additionally, while the present faucet 10 is illustrated with a pair of handle bonnets 18 and handles 20, it will be understood that any number of handles, bonnets, spouts, etc., may be utilized with the internal plumping components herein described.

Referring to FIGS. 4-7, according to an exemplary embodiment, the internal components of the faucet 10 generally include a mounting plate 30, one or more valve assemblies including valve housings 50, and a fluid tube (i.e., waterway tee) 70, which collectively form the faucet mount assembly that is configured to perform the functions of conventional yokes. The mounting plate 30 generally functions as a chassis, providing a structure to which the internal components may be mounted and also providing rigidity for both the internal components and the external components. The valve housings 50 generally selectively receive hot or cold water, provide for coupling the external components to the internal components to form the faucet 10, and provide for mounting the faucet 10 to the surface 22. The fluid tube 70 generally provides for mixing of hot and cold water for delivery to the user.

According to an exemplary embodiment, the mounting plate 30 includes apertures 34 at either ends of the mounting plate 30 and undulations 38*a*, 38*b* forming a channel or depression 40 in the upper surface of the mounting plate 30. The valve housings 50 are press or interference fit into the apertures 34 of the mounting plate 30 and include outlets 54 for receiving the fluid tube 70. The fluid tube 70 is disposed within the channel 40 and extends between the valve housings 50. The fluid tube 70 includes inlets 71 disposed in fluid communication with the outlets 54 of the valve housings 50. The mounting plate 30, valve housings 50, and fluid tube 70 are discussed in turn below.

Figure 8A:
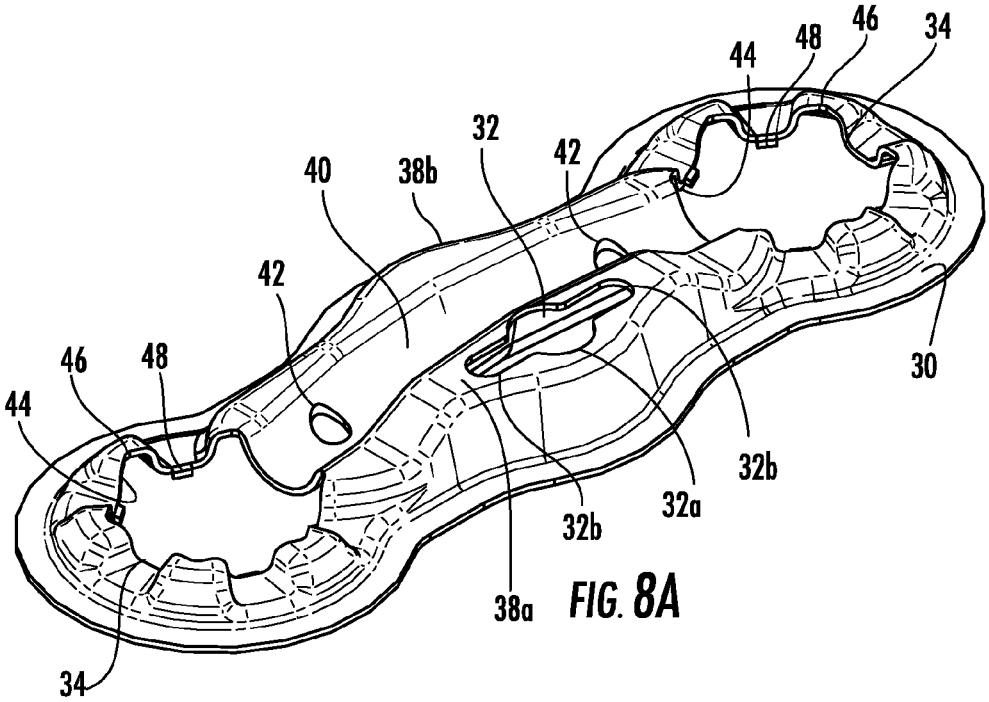
FIG. 8A is a perspective view of a mounting plate of a faucet assembly according to an exemplary embodiment.
Figure 8B:
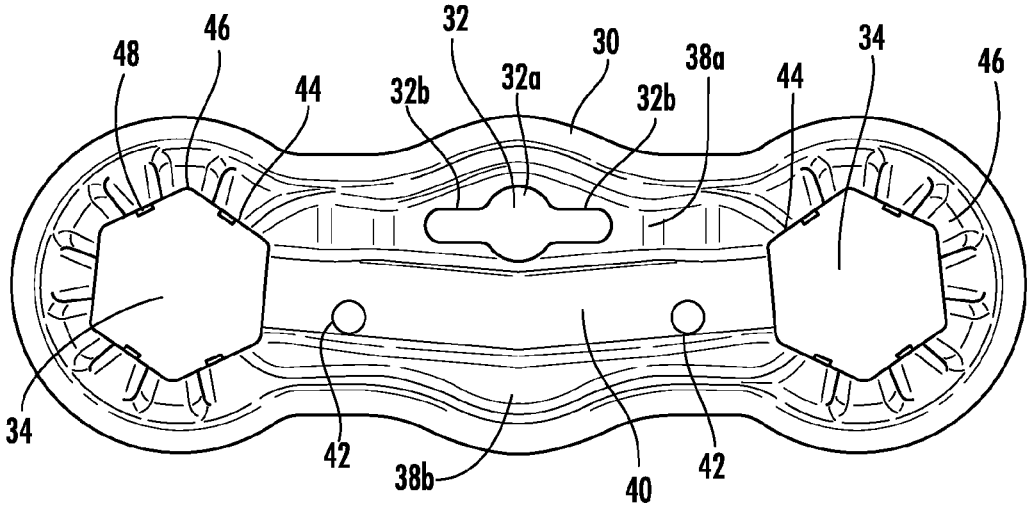
FIG. 8B is a top view of the mounting plate shown in FIG. 8A.
Figure 8C:
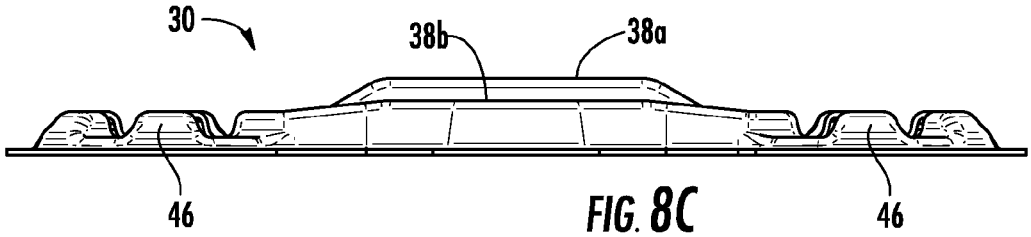
FIG. 8C is a front view of the mounting plate shown in FIGS. 8A and 8B.

Referring to FIGS. 8A, 8B, and 8C, according to an exemplary embodiment, the mounting plate 30 generally provides structure to which the internal and external components may be coupled and to allow mounting of the faucet 10 to the surface 22 (i.e., the mounting plate 30 acts like a chassis, enabling the internal and external components to be coupled together to form the faucet 10). The mounting plate 30 is a generally elongate member that includes various features for receiving other internal components (e.g., valve housings 50 and fluid tube 70) and/or for strengthening the mounting plate 30 to provide structure to the internal components and external components of the faucet assembly 10. The mounting plate 30 is shaped and sized to be disposed generally under the escutcheon 16, such that the mounting plate 30 generally cannot be seen by the user of the faucet during normal use.

According to an exemplary embodiment, the mounting plate 30 is a unitary piece of stamped stainless steel. According to other various embodiments, the mounting plate 30 may be made from other materials (e.g., other metals such as aluminum, magnesium, copper, and alloys thereof; plastics; composites; or any other suitable material), have different dimensions (e.g., thicker or thinner gauge), and/or may be made according to other manufacturing methods (e.g., casting, machining, injection molding, etc.). Although the mounting plate 30 is shown according to an exemplary embodiment as being formed of a single unitary piece, according to other exemplary embodiments, a mounting plate may be formed of multiple pieces (e.g., multiple pieces that are coupled to each other with or without the use of fasteners, or multiple pieces that are not coupled to each other).

According to an exemplary embodiment, the mounting plate 30 includes various apertures. The mounting plate 30 includes apertures 34 configured for coupling the mounting plate 30 to a valve housing 50, an aperture 32 configured to receive a lift-rod therethrough, and drain apertures 42. According to other various embodiments, the mounting plate 30 may include a greater or lesser number of apertures and/or other features to perform the functions described for each of the apertures 34, 32, 42 as described below.

According to an exemplary embodiment, the mounting plate includes apertures 34 that are disposed at opposite ends of the mounting plate 30 and are configured to be aligned with corresponding apertures 35 in the escutcheon 16 (described in further detail below). The apertures 34 are configured to receive the valve housings 50 and may include features configured to allow for rigid engagement with the valve housings 50. More particularly, the size, shape, and other characteristics of the apertures 34 may be configured to enable secure engagement and generally rigid coupling between the mounting plate 30 and the valve housings 50 without the user of fasteners.

According to an exemplary embodiment, each of the apertures 34 may be sized to receive a portion of the one of the valve housings 50 therethrough. Further, the apertures 34 may be sized with tight tolerance to the corresponding valve housings 50 to provide a press or interference fit between the mounting plate and valve housings. For example, according to a particular exemplary embodiment, the apertures 34 may provide a one-way press fit arrangement such that once the valve housings 50 are pressed into engagement with the apertures 34 from above, the valve housings 50 are permanently joined to the mounting plate 30. According to another exemplary embodiment, the apertures 34 may be configured to allow the valve housings 50 to be threaded into the apertures so that removal of the valve housings 50 can be accomplished by rotating the valve housings 50. According to another exemplary embodiment, the valve housings 50 and apertures 34 may each include complementary features that allow the valve housings 50 to be securely yet removably coupled to the mounting plate 30. Those reviewing the present disclosure will appreciate that there are numerous possibilities for coupling the valve housings 50 to the mounting plate 30 in the apertures 34, and that all such possibilities are intended to be included within the scope of the present disclosure.

According to an exemplary embodiment, each of the apertures 34 may be shaped according to the shape of the valve housing 50 which the aperture 34 is to receive. For example, the apertures 34 may each include a polygonal circumference 44 that corresponds to a polygonal valve housing 50. More particularly, the valve housing apertures 34 may have a hexagonal shape that corresponds to a hexagonal shape of the valve housings 50. Further, by providing a complementary polygonal aperture 34, the valve housing 50 is prevented from rotating relative to the mounting plate 30, thus allowing attachment, service, and/or operation of various components (e.g., a valve cartridge 80, a valve stem 92, bonnet 18, or plastic shank 122) without changing relative angular positions of the mounting plate 30 and the valve housings 50. Although shown as having a generally hexagonal shape, it should be understood that the valve housings and apertures for receiving the valve housings may have other shapes or configurations according to other exemplary embodiments.

According to an exemplary embodiment, each of the apertures 34 includes a plurality of ribs or protrusions 46 around the circumference 44 thereof. The ribs 46 are undulations of the mounting plate 30 that extend in varying height from a horizontal plane of the mounting plate 30 (i.e., like waves running around the circumference 44 of the apertures 34). The ribs 46, by having a vertical component, extend contact vertically between the mounting plate 30 and the valve housings 50 (i.e., as opposed to only the thickness of the material forming the mounting plate 30). By providing extended vertical interference, the valve housing 50 may be better held in fixed angular alignment with the mounting plate 30 when torque is applied to the valve housing (e.g., from a user rotating or pushing axially on one of the handles 20 that are connected to the valve housing 50 through a valve stem 92 and cartridge 80 (discussed below)).

According to an exemplary embodiment, each of the apertures 34 may include one or more tabs 48 that extend into the opening 34 from the circumference 44 to engage the valve housing 50. According to one exemplary embodiment, the tab 48 may engage a surface of the valve housing 50. For example, the tab 48 may be configured (e.g., through material, shape, size, etc.) to elastically and/or plastically deform when the aperture 34 receives the valve housing 50. By configuring the tab 48 to engage the surface of the valve housing 50 and to deform, a rigid connection between the mounting plate 30 and the valve housing 50 may be achieved. According to another exemplary embodiment, the tab 48 may engage a feature (e.g., a lip, channel, and/or detent) 59 formed in the valve housing 50 to retain the mounted valve housing 50 within the opening 34. For example, the tab 48 of the mounting plate 30 may snap into/over the feature when the mounting plate 30 receives the valve housing 50 and thereby prevents removal of the valve housing 50 from the mounting plate 30.

According to other exemplary embodiments, the mounting plate 30 may include more, fewer, or different features for rigidly coupling and/or securing the valve housings 50 to the mounting plate 30. For example, more or fewer tabs 48 may be provided, the tabs 48 may be smaller or larger, the size of the valve housing 50 and apertures 34 may be smaller or larger, and/or set screws or other fasteners may be used to rigidly secure the valve housings to the mounting plate.

As shown in FIGS. 8A-8C, the mounting plate 30 includes one or more drainage apertures 42 in the channel 40 that are located proximate the apertures 34 such that any fluid leakage from the valve housing 50, the fluid tube 70, or other part within the faucet 10 will drain through the drainage apertures 42. The drainage apertures 42 are disposed on a front portion of the mounting plate 30 (i.e., toward the user in normal use), such that water may leak through the apertures 42 and out from under the mounting plate 30 to indicate possible leaks in the faucet assembly 10 to the user. The drainage apertures 42 are disposed below outward edges of the channel 40 near the apertures 34. It is intended that this positioning will allow the water to drain down the channel toward the drain apertures 42. The drainage apertures 42 may be of any size, shape, or location sufficient to allow communication of water leaked from the faucet 10 into view of the user, subject to structural or other limitations of the mounting plate 30. According to other exemplary embodiments, the channel 40 may be configured in other manners or include other features to communicate leaked water to be in view of the user (e.g., providing grooves or subchannels within or separate from channel 40 to direct leaked water toward the user).

According to an exemplary embodiment, the mounting plate 30 defines an elongated central aperture 32 having a central portion 32*a* and two slot portions 32*b*. The aperture 32 is configured as a pass-through for the lift rod 24 to extend through the faucet assembly 10 and the surface 22 into a drain. The aperture 32 is generally aligned with a corresponding aperture on the escutcheon. The aperture 32 is also configured to provide access to fasteners used to couple the escutcheon 16 to the spout 12. According to other exemplary embodiments, the aperture 32 may have a different shape (e.g., circle, rectangle, oval, etc.), have a different size (e.g., smaller or larger), be divided into multiple apertures (e.g., dedicated apertures for the lift rod 24 and for providing access to the fasteners), or any combination thereof.

According to an exemplary embodiment, the mounting plate 30 includes a plurality of structural features intended to provide rigidity the internal and external components of the faucet 10. For example, the mounting plate 30 includes a plurality of ridges, ribs, and/or undulations to strengthen the mounting plate 30. A pair of undulations 38*a*, 38*b* generally run between apertures 34. The undulations 38*a*, 38*b* are raised portions of the mounting plate 30 that provide torsional and bending rigidity to the mounting plate 30 (i.e., to prevent twisting or bending of the mounting plate from applied torque or force, such as from the user turning or pushing a handle 20). According to other exemplary embodiments, the undulations 38*a*, 38*b* may be configured in other manners (e.g., having a different cross-sectional shape, width, or height; extending only partially between apertures; aligned in different or multiple directions, include more or fewer undulations, etc.). According to other exemplary embodiments, the mounting plate may include other structural features (e.g., ribs or other structural pieces that are integral or attached to the mounting plate 30, such as by spot-welding).

According to an exemplary embodiment, the undulations 38*a*, 38*b* define a channel 40 that is configured to receive the fluid tube 70. The channel may have a configuration that is complementary to the shape of the fluid tube, such that an upper surface of the fluid tube 70 is at approximately the same height as the undulations 38*a*, 38*b* defining the channel 40. According to other exemplary embodiments, the channel 40 may be configured to receive the fluid tube 70 in additional and/or different manners (e.g., for snap, interference, or press fit of the fluid tube 70 into the channel 40; for a fluid tube 70 height above or below one or more of the undulations 38*a*, 38*b*; for the fluid tube 70 to be disposed generally below the mounting plate). According to another exemplary embodiment, the mounting plate 30 includes no channel 40. The channel 40 may also be configured to funnel leaked water toward drainage apertures 42 (e.g., the channel 40 may have a bowed or crowned configuration such that water flows toward the drainage apertures 42).

Figure 9:
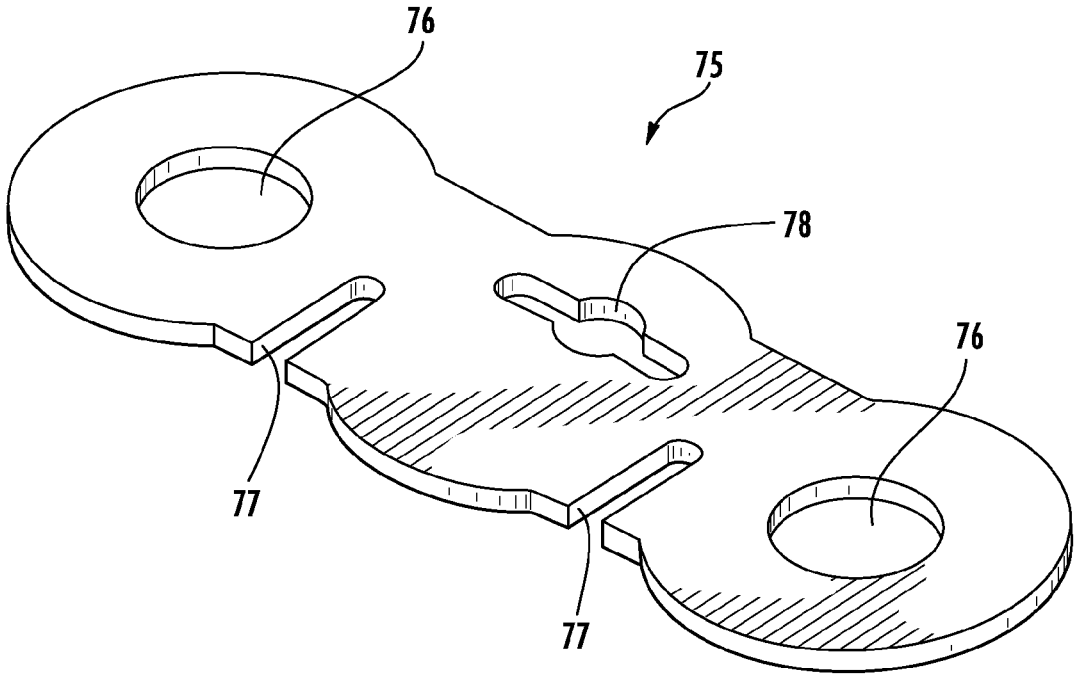
FIG. 9 is a perspective view of a gasket or seal of a faucet assembly according to an exemplary embodiment.

Referring now to FIG. 9, according to an exemplary embodiment, a gasket 75 is provided in the faucet assembly, and is configured to form a compliant and/or watertight seal between the mounting plate 30 and the surface 22 to which the faucet assembly is mounted to prevent relative translational motion between the mounting plate 30 and the surface 22 (i.e., to prevent sliding of the faucet 10) and to account for relative variations of height in the mounting plate 30 and the surface 22 (i.e., to prevent rocking of the faucet 10). During installation, the gasket 75 may be placed the underside of the mounting plate 30 and the upper surface of the support surface 22, such as being attached directly to the mounting plate 30 with an adhesive or being placed without use of an adhesive.

According to an exemplary embodiment, the gasket 75 includes a complementary shape to that of the mounting plate 30, including an outline and apertures that correspond to the mounting plate. For example, the gasket 75 includes valve housing apertures 76 aligned with apertures 34 of the mounting plate, weep channels 77 aligned with the drainage apertures 42 in the channel 40 of the mounting plate 30, and aperture 78 aligned with aperture 32 of the mounting plate 30 for the rod 24. The weep channels 77 direct any fluid that may leak from the upper side of the mounting plate 30 away from the underside of the support surface 22 and to direct the fluid leakage towards the front of the faucet 10 and under the escutcheon 16 for easier recognition by a user. Further, he gasket 75 may also be configured to act as a seal to prevent water from coming out of the apertures 34.

According to an exemplary embodiment, the gasket 72 is an expanded foam material attached to the mounting plate 30 by an adhesive. According to other exemplary embodiments, the gasket may be made from other materials (e.g., other types of foam, rubber, neoprene, or plastic) and may be attached to the mounting plate by other means (e.g., compression by being stretched around the mounting plate, molding such as by overmolding the gasket to the mounting plate, etc.).

Figure 10:
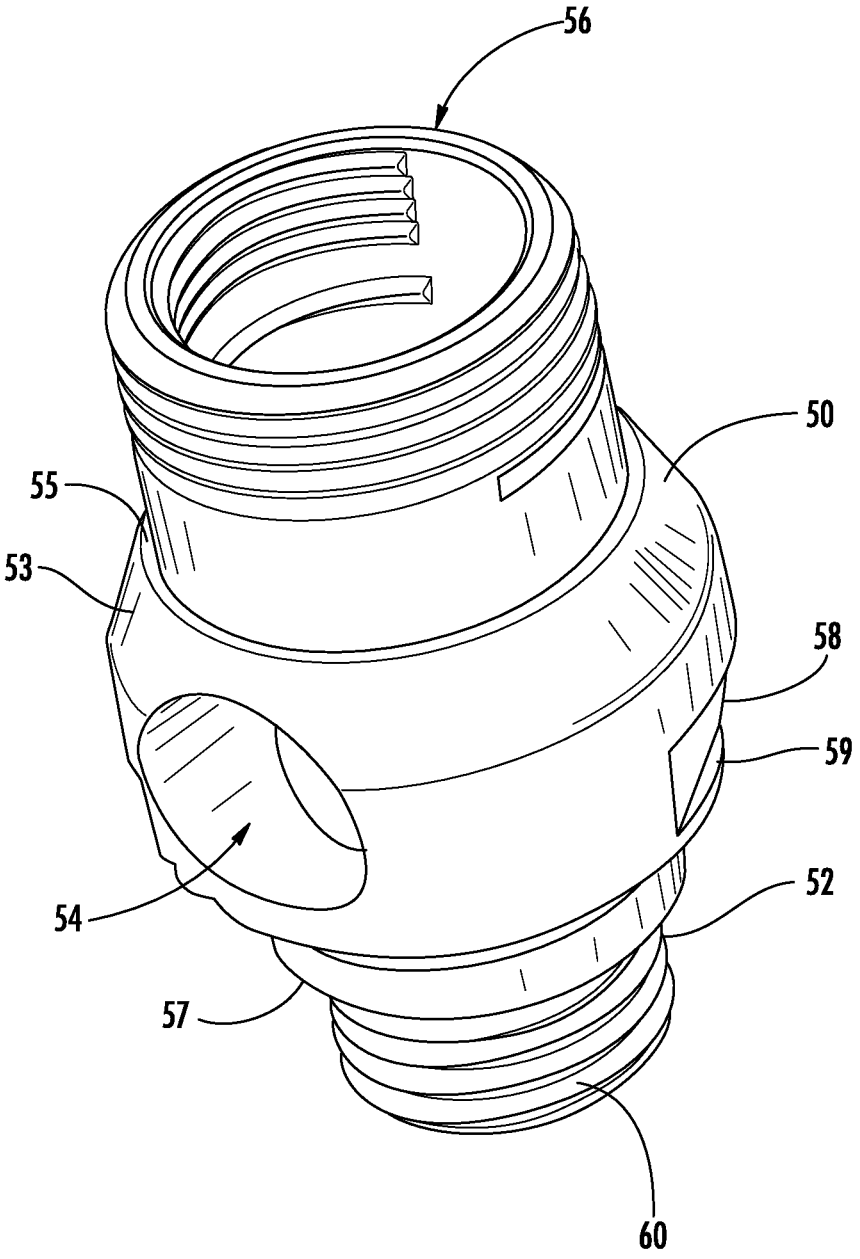
FIG. 10 is a perspective view of a valve housing of a faucet assembly according to an exemplary embodiment.

Referring to FIG. 10, according to an exemplary embodiment, the faucet 10 includes one or more valve housings 50. The valve housings 50 are configured to both selectively allow the flow of hot and cold water to the fluid tube 70, to enable the coupling of external components to internal components to form the faucet 10, and to enable coupling the faucet 10 to the surface 22.

According to an exemplary embodiment, the valve housings 50 are machined from brass bar stock. According to other exemplary embodiments, the valve housings may be formed of different materials (e.g., other metals or alloys, composites, or plastics) and/or may be made according to different processes (e.g., casting, rolling, or injection molding). According to an exemplary embodiment, for example, the valve housings may be made of stainless steel or another material suitable for use in a water valve application.

According to an exemplary embodiment, the valve housings 50 are configured to selectively communicate water from hot and cold supplies to the fluid tube 70. The valve housings 50 generally include a fluid inlet portion 52, a fluid outlet portion 54, and a cartridge receptacle portion 56 for receiving valve components.

According to an exemplary embodiment, each of the valve housings 50 includes a fluid inlet portion 52. The fluid inlet portion 52 is an externally and internally threaded body including a hollow longitudinally extending base portion 60. More particularly, referring to FIGS. 3-4, the fluid inlet portion 52 includes, or is configured to couple to, a supply tube 130, such as, for example, a flexible supply tube, which may be threadably attached by way of a supply coupling 132 to the internal threads of the extending base portion 60. The supply coupling 132, according to an exemplary embodiment, is a conventional coupling including a seal, such as an O-ring, and external threads that engage and are received by internal threads of the fluid inlet portion 52. The fluid inlet portion 52, supply tube 130, and supply coupling 132 collectively allow communication of water from a water supply into the valve housing 50. According to one exemplary embodiment, the supply tube 130 is pre-installed with the faucet 10. It will be appreciated that the supply tubes 130 may be alternatively replaced with any suitable supply tube and/or supply tube adapter as may be desired.

According to an exemplary embodiment, each valve housing 50 includes a fluid outlet portion 54. The fluid outlet portion 54 is configured to communicate water received in the inlet portion 52 to the fluid tube 70 (see e.g., FIGS. 4 and 5). The fluid outlet portion 54 includes a defined aperture adapted to receive one end of the fluid tube 70. More particularly, the fluid outlet portion 54 is configured to sealingly engage the fluid tube 70 by providing a generally cylindrical surface that corresponds to a cylindrical shape of the fluid tube 70. The cylindrical surface is surface is sized such that an O-ring gasket may be compressed between the cylindrical surface of the fluid outlet portion 54 and the fluid tube 70. According to other exemplary embodiments, the fluid outlet portion 54 is configured to sealingly couple the fluid tube including in different manners, for example, providing an internal or external flange against which a gasket and/or a vertical edge of the fluid tube 70 may be seated, providing an internally threaded portion for receiving an externally threaded portion of the fluid tube 70, and/or compressing the fluid tube 70 against the fluid outlet portion 54 by a fastener, clamp, or between a second valve housing 50.

According to an exemplary embodiment, each valve housing 50 includes a valve cartridge receptacle portion 56. The valve cartridge receptacle portion 56 is adapted to receive a valve cartridge that selectively opens and closes (i.e., control) the fluid path between the inlet portion 52 and the outlet portion 54. The valve cartridge receptacle portion 56 is configured to receive a valve cartridge 80 and is generally cylindrical and internally threaded. The internal threads are configured to engage corresponding external threads of the valve cartridge 80 to couple the valve cartridge to the valve housing. The valve cartridge receptacle portion 56 may be configured in other manners to couple the valve cartridge 80 to the valve housing 50, such as providing a different shape (e.g., polygonal or ovular) or different coupling means (e.g., press fit or by use of fasteners).

Figure 11A:
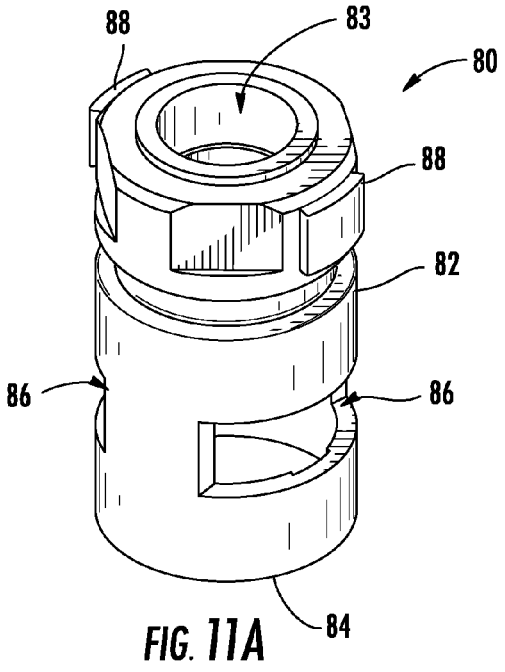
FIG. 11A is a perspective view of a valve cartridge of a faucet assembly according to an exemplary embodiment.

Referring generally to FIG. 11A-11D, according to an exemplary embodiment, a valve assembly generally includes valve components, such as the valve cartridge 80, the valve stem 92, a drive disk 100, and a stationary disk 110. The valve cartridge itself may be any suitable valve cartridge, including, for example a valve cartridge 80 as illustrated in FIG. 11A. Because the valve cartridge sits within the mounted valve housing 50, the valve cartridge 80 is replaceable within the valve housing 50 without having to remove the mounting plate 30 from the support surface 22. According to other exemplary embodiments, valve assemblies may include more, fewer, or different components that are similarly configured to selectively allow water flow from a supply, through the valve housings 50, and into the fluid tube 70.

According to an exemplary embodiment, the valve components are made from machined brass. According to other exemplary embodiments, the valve components may be made from other materials (e.g., other metals or alloys, composites, or plastic) and/or may be made according to other manufacturing methods (e.g., casting, machining, stamping, injection molding, any suitable combination thereof, etc.).

According to an exemplary embodiment, the valve cartridge 80 includes an annular housing body 82 with an internal cavity 83 disposed along a main axis and in communication with a bottom inlet 84 and two opposite side outlets 86. As such, the pathway through the valve is from the inlet 84 up through the lower portion of the cavity 83 and out through the outlets 86. Two keyed tabs 88 spaced apart 180 degrees extend outward from the top of the housing 82 and ensure the valve cartridge 80 is properly aligned when inserted into the valve housing 50. The housing 82 also includes an O-ring 90 (see FIG. 5) below the stop tabs 88. A retention nut 89 removably retains the valve cartridge 80 in the valve housing 50.

Figure 11B:
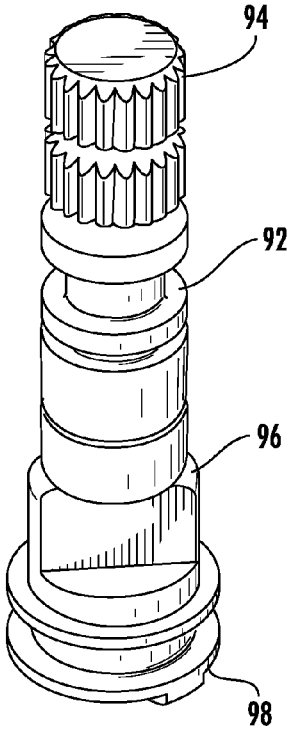
FIG. 11B is a perspective view of a valve stem of a faucet assembly according to an exemplary embodiment.

Referring to FIG. 11B, the valve stem 92 is disposed along the axis inside the housing 82 and has a splined upper end 94 for mounting the faucet handle 20. The valve stem includes a limiter 96 that interfere with stop tabs (not shown) within the housing 82 to limit rotation of the valve stem 92 in each direction. The limiter is preferably designed to be reversible, so that the valve stem 92 can work with either a left-hand or a right-hand faucet.

Figure 11C:
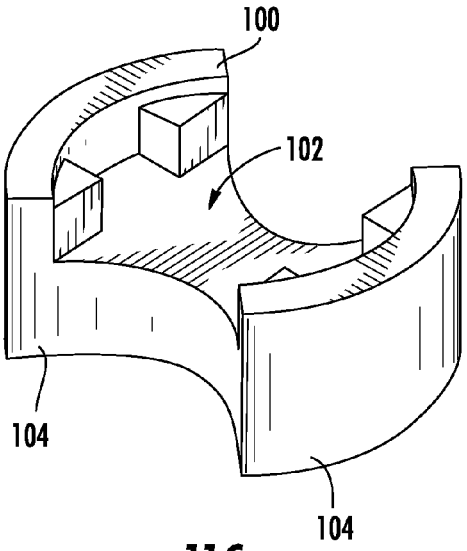
FIG. 11C is a perspective view of a valve drive disk of a faucet assembly according to an exemplary embodiment.
Figure 11D:
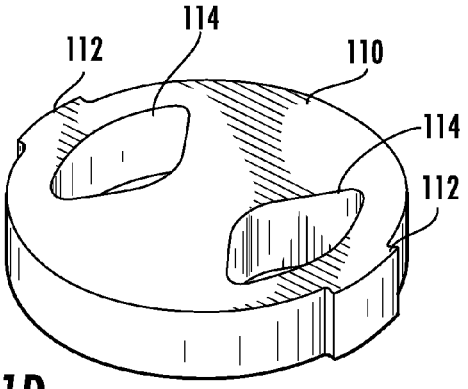
FIG. 11D is a perspective view of a valve stationary disk of a faucet assembly according to an exemplary embodiment.

Referring to FIGS. 11B and 11C, according to an exemplary embodiment, at the bottom of the valve stem 92 is a drive bar 98 that is received in a slot 102 of a drive disk 100. The drive disk 100 is a bowtie-shaped rotatable disk having two wings 104. The downward face of the drive disk 100 is flat and smooth and slides against the smooth upper face of a stationary disk 110 (FIG. 11D) which is held fixed against rotation with respect to the housing 82 by the engagement of two ears 112 being received in corresponding slots of the housing 82. The stationary disk 110 includes two triangular openings 114.

According to an exemplary embodiment, in a closed position of the valve, the wings 104 of the drive disk 100 align with the openings 114 of the stationary disk 110 so that fluid flow is blocked. By turning the valve stem 92 a predetermined amount, such as, for example ninety degrees, the drive disk 100 is rotated to align the spaces between the wings 104 with the openings 114 and the outlets 86 of the housing 82 to thereby allow fluid flow from the inlet 84 to the outlets 86.

According to an exemplary embodiment, and as discussed above, the valve housings 50 are configured to be received by the mounting plate 30 to form a generally rigid coupling therebetween. More particularly, the valve housing 50 also includes features for coupling the valve housing 50 to the mounting plate 30, including a seat 57, mating surface 58, and detent 59 (see FIG. 10). The seat 57 is configured to rest on top of the undulations of the aperture 34 of the mounting plate 34. The seat 57 maintains vertical orientation of the valve housing 50 with respect to the mounting plate 30 and, as discussed below, enables the faucet 10 to be attached to the surface 22. An outer surface of the valve housing 50 above the fluid inlet portion, e.g., the mating surface 58 is reciprocally shaped with the aperture 34. As discussed above, the corresponding shapes of the mating surface 58 and the aperture 34 prevent relative rotation of the valve housing with respect to the mounting plate. The valve housing 50 may also include the corresponding detent 59 to receive the tab 48. As discussed above, when the valve housing 50 is fitted within the opening 34 so that the tab 48 engages the detent 59, the valve housing is semi-permanently retained in the mounting plate 30.

According to an exemplary embodiment, the valve housings 50 are configured to couple the internal and external faucet components to form a faucet assembly. More particularly, each receptacle portion 56 is configured to couple to one of the bonnets 18. The receptacle portion 56 is externally threaded to allow the housing bonnets 18 to be threadably secured to the valve housing 50. The valve housing includes a beveled seat 53 and/or a horizontal seat 55, which correspond to a similarly shaped interior surface of the escutcheon 16 (described in further detail below). The bonnets 18 similarly each include a lower periphery surface that corresponds to an exterior/upper surface of the escutcheon 16. The escutcheon 16 is placed over the mounting plate 30, valve housings 50, and fluid tube 70 (i.e., a multi-piece faucet mount assembly), and apertures 35 of the escutcheon 16 receive the receptacle portions 56 of the valve housings 50. The bonnets 18 are then screwed to the external threads of the receptacle portions 56 of the valve housing 50, and tightened to rigidly secure the escutcheon 16 between the bonnet 18 and the valve housing 50. Thereby, the external components (e.g., escutcheon 16, spout body 12, and bonnets 18) form a structural unit with the internal components (e.g., mounting plate 30, valve housing 50, and fluid tube 70). According to other embodiment, the receptacle portion 56 and bonnets 18 may be configured in other manners including, for example, different coupling means (e.g., fasteners, or adhesives) or no coupling (e.g., the bonnets 18 coupling directly to or integral with the escutcheon 16).

Referring again to FIGS. 3-4, according to an exemplary embodiment, the valve housings 50 are configured to rigidly hold the faucet 10 to the support surface 22. More particularly, plastic shanks 122 are provided for each valve housing 50, with the shanks 122 being internally threaded for coupling to the external threads of the extending base portion of the fluid inlet portion 52 of the valve housing 50. The shank 122 is selectable to be of sufficient length to extend through the support surface 22 as necessary and generally surrounds a portion of the supply tube 130 and the supply coupling 132. The shanks 122 each include external threaded surface for receiving plastic mounting nuts 120, which engage an external surface of the plastic shank 122. When tightened, the mounting nuts 120 pull the plastic shanks 122 (and, therefore, the inlet portion 54 of the valve housings 50) through apertures of the support surface 22, thereby rigidly hold the mounting plate 30 to the support surface 22 between the valve housing 50 and the mounting nut 120. According to other various embodiments, the valve housing 50, plastic shank 122, and mounting nut 120 may be configured in other manners including, for example, using different materials for the plastic shank 122 and mounting nut 120 (e.g., metal or other plastic). According to other exemplary embodiments, the inlet portion of the valve housing may be extended so as to eliminate the need for the plastic shank.

Figure 12A:
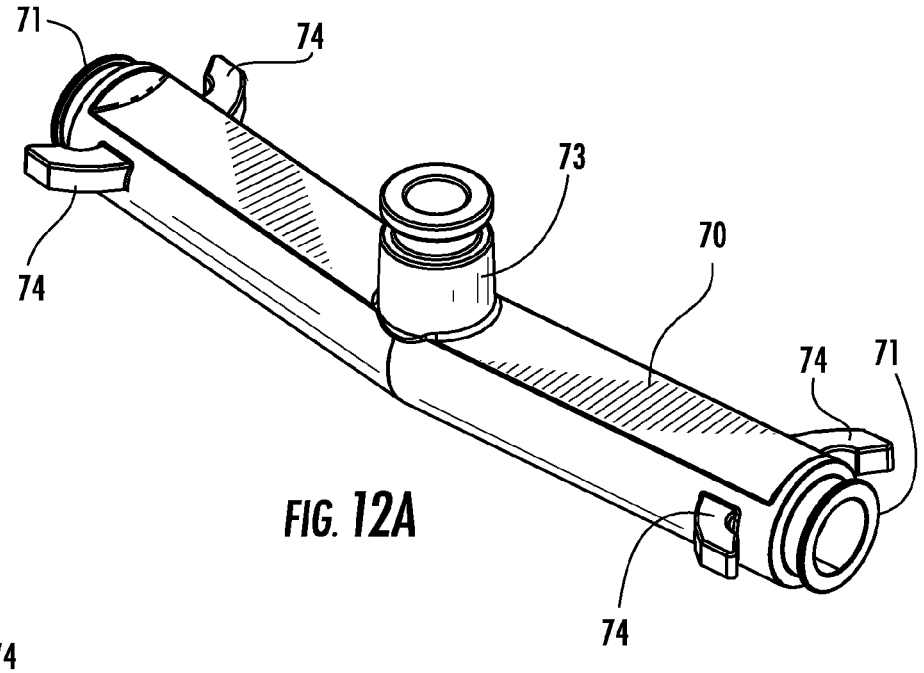
FIG. 12A is a perspective view of a fluid tube of a faucet assembly according to an exemplary embodiment.
Figure 12B:
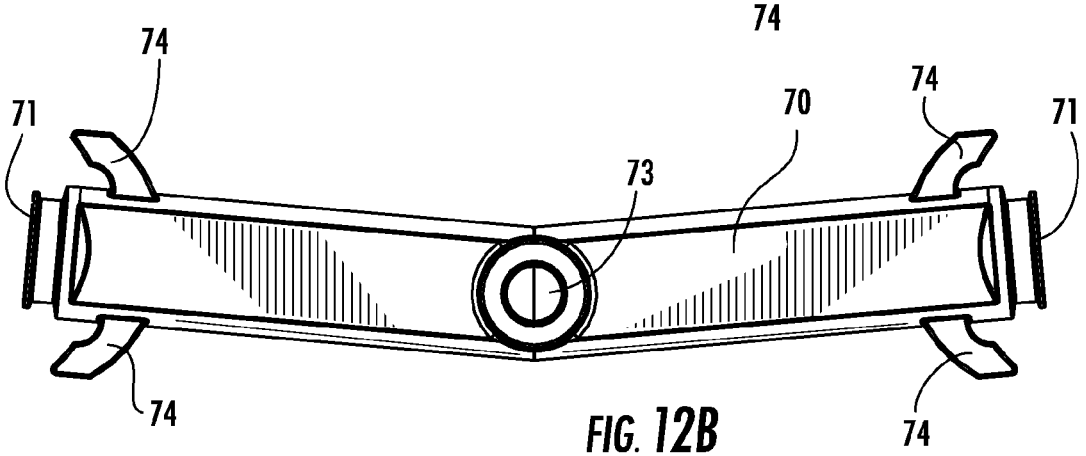
FIG. 12B is a top view of the fluid tube shown in FIG. 12A according to an exemplary embodiment.
Figure 12C:
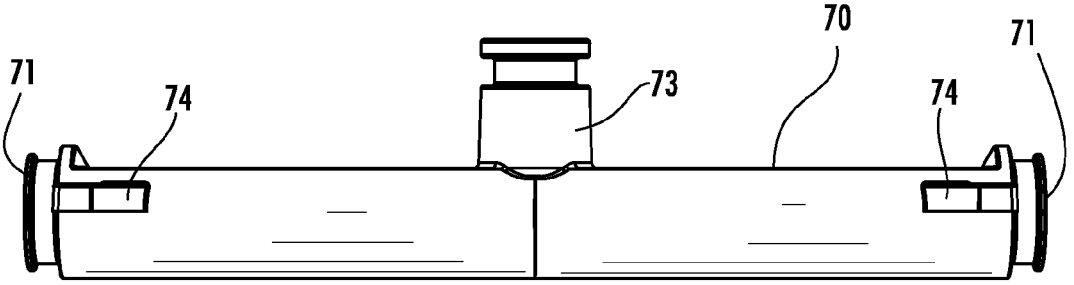
FIG. 12C is a perspective view the fluid tube shown in FIGS. 12A and 12B according to an exemplary embodiment.

Referring now to FIGS. 12A, 12B, and 12C, according to an exemplary embodiment, the fluid tube 70 extends the fluid path from the valve housings 50 towards the fluid outlet end 15 of the spout 12. More particularly, the fluid tube 70 is configured to receive supply water from the valve housings 50, mix hot and cold water, and communicate water to the spout body 12 for delivery to the user.

According to an exemplary embodiment, the fluid tube 70 is made from injection molded plastic. According to other exemplary embodiments, the fluid tube may be made from different materials (e.g., metals or alloys, composites, or other plastics) and/or according to other manufacturing methods (e.g., casting, machining, stamping, rolling, blow molding, any suitable combination thereof, etc.).

According to an exemplary embodiment, the fluid tube 70 includes two inlets 71 and a spout outlet 73 and is retained (e.g., seals) within the fluid outlet portions 54 of the valve housings 50 via any suitable sealing apparatus, including, for instance, an O-ring provided on the spout outlet 73 or an integrally-formed seal that may be part of the spout outlet 73. More particularly, the two inlets 71 are configured to be received in (or otherwise sealingly engage) the outlet portions 54 of the valve housings 50. For example, the two inlets 71 are generally cylindrical and have a flange for receiving an O-ring gasket. Each of the inlets 71 are received in the corresponding outlet portion 54 of one of the valve housing 50 and are held in position, for example, by the generally fixed positions of the valve housings 50 on the mounting plate 30. As discussed above, according to other exemplary embodiments, the fluid tube 70 may be configured in other manners for sealingly engaging the outlet portions 54 of the valve housings 54.

According to an exemplary embodiment, the fluid tube 70 is configured to mix hot and cold water received from the valve housings 50. The fluid tube 70 includes a central chamber or conduit, which receive the hot and cold water for mixing before transferring mixed water to the spout outlet 73.

According to an exemplary embodiment, the fluid tube 70 is configured for conveying water from the valve housing 50, as described herein, to the spout body 12 for delivery to the user. The fluid tube 70 includes a spout outlet 73 that is adapted to mate with an internal spout tube (not shown) of the spout body 12, to communicate fluid from fluid tube 70 to the fluid outlet end 15 without the fluid contacting the internal surfaces of the spout body 12. The spout outlet 73 may, for example, include a male end and an O-ring gasket that are received by a female adapter or integral portion of the internal spout tube of the spout body 12. The fluid tube 70 and/or spout outlet 73 may be configured in other manners for communicating water to the spout tube of the spout body including, for example, providing a flange against which the spout tube or gasket may be seated, configuring the spout outlet 73 as a female receptacle or otherwise provide an internal female receptacle for receiving a male member of a male adapter or male portion of the spout tube, and/or providing other coupling means for coupling the spout tube to the fluid tube 70 (e.g., fasteners, brackets, clamps, etc.).

According to an exemplary embodiment, the fluid tube 70 also includes protrusions or wings 74 adjacent the inlets 71. The protrusions 74 are disposed on opposite sides of each inlet 71 so as to partially surround a portion of the valve housing 50. The protrusions 74 prevent over-insertion of the inlets 71 into the outlet portions 54 of the valve housings 50. The protrusions 74 also hold the valve housings 50 at a minimal distance apart, aiding assembly and providing added structure. The protrusions 74 may also prevent rotation of the fluid tube 70 relative to the valve housings 50. According to other exemplary embodiments, the fluid tube 70 or valve housings 50 may include more, fewer, or different features that perform functions similar to the protrusions 74 (e.g., a flange on the fluid tube 70, a seat disposed in the outlet 54 of the valve housing, complementary polygonal cross-sections to prevent relative rotation).

Figure 13:
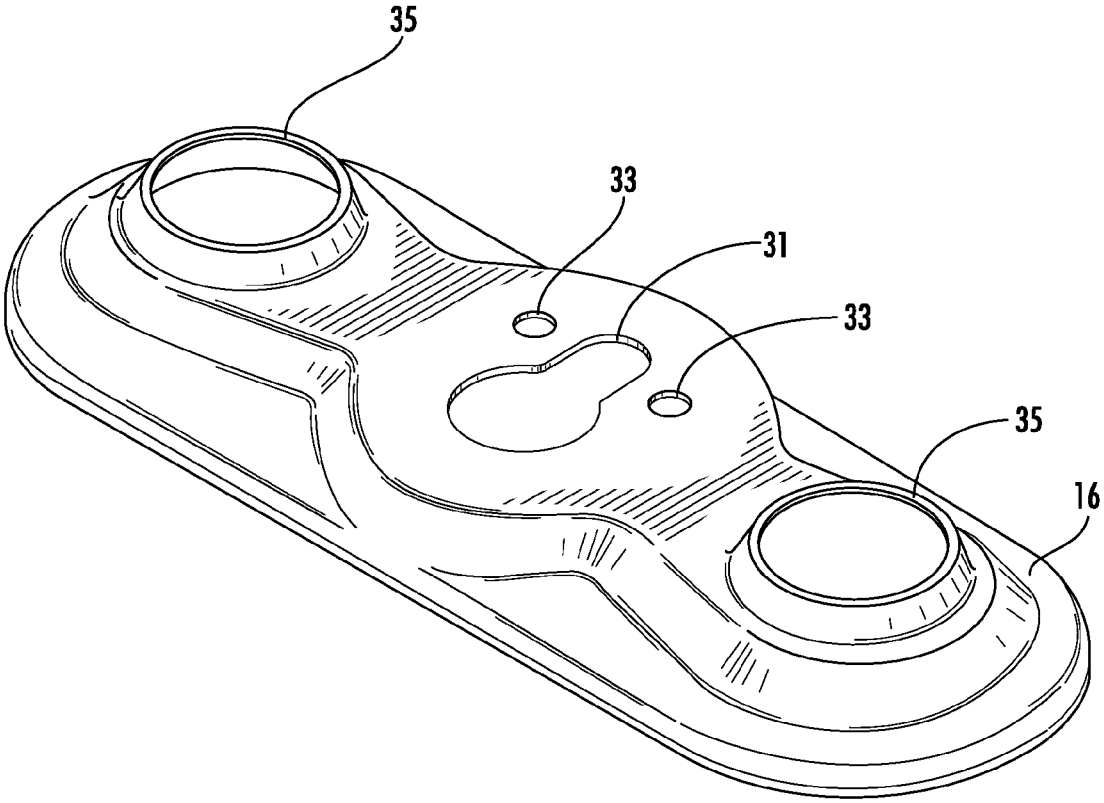
FIG. 13 is a perspective view of an escutcheon or base of a faucet assembly according to an exemplary embodiment.

Referring to FIG. 13, an escutcheon 16 is provided. The escutcheon 16 is generally elongate and includes various apertures and aesthetic features. The escutcheon 16 is also configured to cover internal components of the faucet 10 from view and, along with the valve housings 50 and bonnets 18, secure the external components of the faucet 10 to the internal components.

According to an exemplary embodiment, the escutcheon 16 includes various apertures that correspond to apertures of the mounting plate and the spout outlet 73 of the fluid tube 70. Particularly, the escutcheon 16 defines a central fluid aperture 31, two mounting apertures 33, and two valve housing apertures 35 for the valve housing 50. The central fluid aperture 31 is located to align with both the spout portion of the fluid tube 70 to allow the fluid tube 70 to communicate with the fluid outlet end 15, and to align with the central portion 32*a* of the elongated central aperture 32 to allow the lift rod 24 to pass through both the escutcheon 16 and the mounting plate 30. The mounting apertures 33, meanwhile, are respectively adapted to align with the two slot portions 32*b* of the elongated central aperture 32. The mounting apertures 33 are configured to receive fasteners (not shown), such as, for example, screws, clips, bolt, etc., to mount the spout body 12 and the escutcheon 16 to the mounting plate 30, the spout body 12 including corresponding apertures (not shown), such as an internally threaded member, for receiving the fastener passing through the mounting apertures 33 of the escutcheon 16. According to other exemplary embodiments, the escutcheon 16 may include more or fewer apertures and/or other features configured to perform similar functions to the apertures (e.g., providing C-shaped cutouts for the valve housings 50, lift rod 24, or spout outlet 73 to pass through).

According to an exemplary embodiment, the escutcheon 16, bonnets 18, and valve housings 50 are configured to couple the external components to the internal components of the faucet 10. As discussed above, the valve housings 50 include valve cartridge receptacle portions 56 that are externally threaded for receiving the internally threaded bonnets 18, and beveled and horizontal seats 53,55 that are complementary to the interior surface of the escutcheons 16. More particularly, each escutcheon 16 includes a generally angular and/or a generally flat lower surface that surround apertures 35. The lower surfaces correspond to and are complementary to the shape of the beveled and/or horizontal seats 53, 55 of the valve housing 50. The escutcheon also includes a generally flat upper surface that corresponds to a generally flat lower periphery of the bonnets. As such, the bonnets 18 may be screwed to the valve housings 50, so as to rigidly hold the escutcheon 16 against the beveled and/or horizontal seats 53, 55 of the valve housing and the lower periphery of each bonnet 18. Accordingly, the exterior components may be rigidly coupled to the interior components of the faucet assembly 10.

According to an exemplary embodiment, the escutcheon 16 is configured to generally cover internal components of the faucet 10 from view. The escutcheon 16 may, for example, have a shape and outline that generally surrounds the periphery of mounting plate 30. Further, the escutcheon 16 may have a height that provides a small gap between the escutcheon 16 and surface 22 to all leaked water to appear from under the escutcheon and to prevent contact that may damage the surface 22 (e.g., scratching).

According to the exemplary embodiments described above, the faucet assembly 10 and multi-piece yoke provides many advantages. These advantages include, but are not limited to, ease of installation and maintenance, compliance with low lead regulations, cost reduction, ease of manufacturing and assembly, and expanded design options.

According to an exemplary embodiment, the faucet assembly 10 and multi-piece yoke provides easier installation and maintenance. As described herein, because the supply tubes are attached prior to installation of the faucet, the installer's time under the support surface may be reduced. Additionally, the supply tube attachment points give installers all the options they currently have with current designs. Further, once attached to the support surface 22, most faucet maintenance can be accomplished from above the sink deck by simply removing the handles 20, the bonnets 18, the escutcheon 16, and/or the spout body 12 as necessary. For example, the valve cartridge 80 may be serviced by removing the handle 20 and the bonnet 18 overlaying the effected cartridge 80. Similarly, the external components may be removed and/or replaced as desired without removing the internal plumbing components from the support surface 22.

According to an exemplary embodiment, the faucet assembly 10 and multi-piece yoke comply with low lead regulations. The example faucet and multi-piece yoke described herein complies with the introduction of Low Lead legislation, which limits the amount of lead that can be in contact with water in a faucet fixture. The multi-piece yoke allows using lower amounts of brass as compared to conventional yokes by, for example, providing a plastic fluid tube 70 and allowing for alternative valve housing 50 and valve component materials.

According to an exemplary embodiment, the faucet assembly 10 and multi-piece yoke save cost as compared to conventional brass yokes that comply with low lead regulations. In place of the conventional yoke, cheaper stampings, inexpensive plastic parts, and less Low Lead compliant brass needs to be used.

According to an exemplary embodiment, the faucet assembly 10 and multi-piece yoke allow for easier and less complex manufacturing. In one example, the faucet uses a stainless steel stamping as the backbone of the mounting hardware. In one example, the faucet also utilizes a brass valve housing that is capable of being machined straight out of bar. Similarly, the valve housings shown are press fit into the mounting hardware, eliminating the need for fasteners to hold the whole assembly together. It should be noted that any suitable elements or combination of elements providing the coupling of the valve housing and the mounting plate without the need for additional fasteners may be used. It should also be noted that fasteners may be used in addition to these elements in other examples.

According to an exemplary embodiment, the faucet assembly 10 and faucet mount assembly allow for expanded aesthetic designs. For example, the stamped mounting plate and plastic fluid tube provide a lower profile than conventional yoke and, thus, allow for thinner escutcheons. Further, the valve housings may be mounted lower to the mounting surface, allowing for smaller and/or slimmer handle bonnets. And, threading the outside of the valve housings allow for complementary threaded bonnets that eliminate gaps between the escutcheon and bonnet. Also, because a spout tube carries water to the user (i.e., as opposed to the spout body itself), greater more materials may be used to form the spout body to provide for different aesthetics. Further, the multiple pieces of the faucet assembly may be made from different materials and/or in different configurations allowing expanded design options. For example, the mounting plate may be made from a material stronger than stainless steel, thus allowing a lower profile mounting plate while providing similar rigidity to the faucet. Similarly, the faucet tube may be configured to have different cross-sectional shapes (e.g., wider, flatter), or have lower profile wall thicknesses to allow for a lower profile faucet mount assembly, which allows for lower-profile escutcheons.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGS. It should be noted that the orientation of various elements may differ according to other exemplary embodiments, and that such variations are intended to be encompassed by the present disclosure.

It is important to note that the construction and arrangement of the dual gear assemblies as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A faucet mount assembly comprising:

a mounting plate configured to receive a first valve housing, the mounting plate including a channel having a drainage aperture disposed therein; and a fluid tube disposed within the channel, the fluid tube being removably coupled to and in fluid communication with the first valve housing, wherein the fluid tube includes an outlet for routing water from the first valve housing to a spout of a faucet;

wherein the channel has a bowed surface including a raised portion within the channel that slopes downwardly to direct any fluid leakage from the first valve housing, the fluid tube, or spout toward the drainage aperture.

2. The faucet mount assembly of claim 1, wherein the mounting plate is further configured to receive a second valve housing, wherein the mounting plate comprises a first aperture and a second aperture, wherein the first valve housing is disposed at least partially within the first aperture of the mounting plate, and wherein the second valve housing is disposed at least partially within the second aperture of the mounting plate.

3. The faucet mount assembly of claim 2, wherein the first valve housing and second valve housing each include an outlet that is a female receptacle, and wherein the fluid tube includes first and second inlets that are male members disposed within the female receptacles of the first valve housing and second valve housing, respectively.

4. The faucet mount assembly of claim 3, wherein the fluid tube comprises a plurality of protrusions and the plurality of protrusions comprise a first protrusion disposed proximate the first inlet to engage an outer surface of the first valve housing and a second protrusion disposed proximate the second inlet to engage an outer surface of the second valve housing.

5. The faucet mount assembly of claim 3, wherein the first inlet of the fluid tube is sealingly engaged with the outlet of the first valve housing and the second inlet of the fluid tube is sealingly engaged with the outlet of the second valve housing.

6. The faucet mount assembly of claim 5, wherein a first seal is disposed between the first inlet of the fluid tube and the first valve housing and a second seal is disposed between the second inlet of the fluid tube and the second valve housing.

7. The faucet mount assembly of claim 5, wherein the outlet of the fluid tube is provided between the first inlet and the second inlet of the fluid tube.

8. The faucet mount assembly of claim 2, wherein the first valve housing and the second valve housing are each configured to couple the faucet mount assembly to a mounting surface.

9. The faucet mount assembly of claim 8, wherein:

the first valve housing and second valve housing each comprise an externally threaded portion; and each externally threaded portion is configured to receive a mounting fastener to cooperatively rigidly hold the mounting plate and mounting surface between the valve housing and mounting fastener.

10. The faucet mount assembly of claim 9, wherein:

each externally threaded portion of the first valve housing and the second valve housing is formed on a shank;

each shank comprises an internally threaded portion for coupling to a lower, externally threaded portion of the first valve housing or the second valve housing.

11. The faucet mount assembly of claim 2, wherein:

the first valve housing and second valve housing each comprise an upper portion configured to receive a bonnet; and each upper portion and bonnet are configured to cooperatively rigidly hold an escutcheon between the bonnet and corresponding valve housing.

12. The faucet mount assembly of claim 11, wherein each upper portion of the first valve housing and second valve housing is externally threaded and each bonnet is internally threaded.

13. The faucet mount assembly of claim 1, wherein at least a portion of a top surface of the fluid tube between the outlet and the first valve housing is flat.

14. The faucet mount assembly of claim 13, wherein the channel is defined at least partially by a first undulation and a second undulation, and wherein the flat portion of the top surface of the fluid tube is at generally the same height as at least one of the first undulation and the second undulation.

15. The faucet mount assembly of claim 1, further comprising a first supply tube, wherein the first valve housing comprises a inlet portion coupled to the first supply tube.

16. A faucet mount assembly, comprising:

a generally elongated mounting plate including:

a first and second aperture disposed at opposite ends thereof, the first and second apertures configured to receive a first valve housing and a second valve housing; and a channel provided between the first and second apertures;

wherein a drainage aperture is provided within the channel; and wherein the channel has a bowed surface including a raised portion within the channel to direct leaked water downward along the bowed surface toward the drainage aperture.

17. The faucet mount assembly of claim 16, wherein the mounting plate further includes a tab that extends into each of the two apertures to engage the respective valve housing, thereby providing a rigid connection between the mounting plate and the valve housings.

18. The faucet mount assembly of claim 16, wherein the two apertures of the mounting plate are polygonal.

19. A faucet mount assembly configured to mount to a mounting surface, comprising:

a generally elongated mounting plate, the mounting plate including two apertures configured to receive first and second valve housings and provided on opposite ends of the mounting plate, a channel provided between the two apertures, and a drainage aperture disposed within the channel; and a gasket configured to form a watertight seal between the mounting plate and the mounting surface, the gasket including a drainage channel extending outwardly to a peripheral edge of the gasket;

wherein the drainage channel is configured to be aligned with the drainage aperture when the mounting plate is coupled to the gasket.

20. The faucet assembly of claim 19, wherein the first and second valve housings are configured to receive fasteners to rigidly hold the mounting plate and a mounting surface between the first and second valve housings and fasteners.

21. The faucet assembly of claim 19, wherein the drainage channel directs any fluid that may leak from an upper side of the mounting plate away from an underside of the mounting surface.

22. A faucet assembly comprising:

a first valve housing and a second valve housing;

a fluid tube coupled to the first valve housing and the second valve housing;

a metal mounting plate comprising a channel for receiving the fluid tube, a first aperture for coupling the first valve housing to the mounting plate, a second aperture for coupling the second valve housing to the mounting plate, and a drainage aperture disposed within the channel; and a first plastic shank extending downward from the metal mounting plate and coupled to the first valve housing and a second plastic shank extending downward from the metal mounting plate and coupled to the second valve housing; and wherein the channel is defined by a bowed surface including a raised portion within the channel that slopes downwardly to direct leaked water toward the drainage aperture.

23. The faucet assembly of claim 22, wherein the first and second plastic shanks include internal threads for coupling to the first and second valve housings, respectively.

24. The faucet assembly of claim 22, further comprising a first fluid supply coupled to the first valve housing and a second fluid supply coupled to the second valve housing;

wherein the first and second plastic shanks surround at least a portion of the first and second fluid supplies.

25. The faucet assembly of claim 22, wherein when the mounting plate is coupled to a mounting surface, the first and second valve housings are coupled to the mounting plate, and the first and second plastic shanks are coupled to the first and second valve housings, the first and second plastic shanks extend below a bottom surface of the mounting surface.

26. The faucet assembly of claim 22, wherein the mounting plate further comprises at least one drainage aperture disposed therein.

* * * * *